United States Patent [19]

Reist

[11] Patent Number: 4,898,336

[45] Date of Patent: Feb. 6, 1990

[54] APPARATUS FOR THE CONTINUOUS WINDING-UP OR WINDING-OFF OF SUBSTANTIALLY FLAT STRUCTURES INTO A PACKAGE AND FROM A PACKAGE, RESPECTIVELY

[75] Inventor: Walter Reist, Hinwil, Switzerland

[73] Assignee: Ferag AG, Hinwil, Switzerland

[21] Appl. No.: 163,346

[22] Filed: Mar. 2, 1988

[30] Foreign Application Priority Data

Mar. 6, 1987 [CH] Switzerland ..... 00860/87

[51] Int. Cl.[4] ..... B65H 75/00; B65H 19/12

[52] U.S. Cl. ..... 242/59; 242/66; 242/58.6

[58] Field of Search ..... 242/66, 59, 68.4, 67.1 R, 242/57

[56] References Cited

U.S. PATENT DOCUMENTS

| | | | |
|---|---|---|---|
| 4,589,603 | 5/1986 | Müller | 242/59 |
| 4,682,741 | 7/1987 | Honegger | 242/59 X |
| 4,705,227 | 11/1987 | Honegger | 242/59 |
| 4,706,905 | 11/1987 | Torres | 242/68.4 |
| 4,741,487 | 5/1988 | Balass | 242/66 X |

FOREIGN PATENT DOCUMENTS

| | | |
|---|---|---|
| 0054973 | 6/1982 | European Pat. Off. . |
| 1112692 | 8/1961 | Fed. Rep. of Germany . |
| 2342515 | 2/1975 | Fed. Rep. of Germany . |
| 559691 | 3/1975 | Switzerland . |
| 2121771 | 1/1984 | United Kingdom . |

*Primary Examiner*—Donald Watkins

*Attorney, Agent, or Firm*—Willian Brinks Olds Hofer Gilson & Lione

[57] ABSTRACT

A driven winding core member is elevationally displaceable and a supply spool member serves for the delivery or reception, as the case may be, of a winding band which can be wound-up with the flat structures or can be unwound in conjunction with the flat structures. A conveyor device serves for the infeed or outfeed of the flat structures which are to be respectively wound-up on or wound-off from the winding core member. Between the conveyor device and the winding core member, there is provided a conveyor band arrangement which either infeeds the flat structures and the winding band or outfeeds such flat sturctures and the winding band. To reduce the space requirements of the apparatus and to simplify driving thereof and still afford a faultless winding-up and winding-off or unwinding operation, the conveyor band arrangement is designed as a freely revolving structure and, under resilient or spring action, partially wraps about the winding core member or, as the case may be, the package located thereupon. The drive elements for the winding core member protrude from a substantially vertically guided displaceable carriage or slide member which can be selectively raised and lowered, i.e., elevationally displaced, by an elevational or lift drive controllable as a function of the momentary position of the conveyor band arrangement.

15 Claims, 3 Drawing Sheets

APPARATUS FOR THE CONTINUOUS WINDING-UP OR WINDING-OFF OF SUBSTANTIALLY FLAT STRUCTURES INTO A PACKAGE AND FROM A PACKAGE, RESPECTIVELY

BACKGROUND OF THE INVENTION

The present invention relates to a new and improved construction of an apparatus for the continuous winding-up or winding-off or unwinding of substantially flat or superficial structures or products into a package or from a package, respectively.

Generally speaking, the apparatus of the present development for the continuous winding-up or unwinding of substantially flat or superficial structures or products, especially, although not exclusively, printed products, in an imbricated or shingled formation, into a package or product package or from a package or product package, respectively, is of the type comprising a driven winding core member which can be elevationally displaced or shifted in position There is also provided a supply spool member for a winding band or tape, sometimes also referred to in the art as a winding strap, which is reeled or wound-up in conjunction with the substantially flat structures or unreeled or unwound in conjunction with the substantially flat structures. Additionally, there is provided a conveyor device for the selective infeed or outfeed of the substantially flat structures which are to be wound-up or unwound, as the case may be, as well as a conveyor band arrangement arranged between the conveyor device and the winding core member. The conveyor band or belt arrangement serves to selectively infeed or outfeed, as the case may be, the substantially flat structures or products and the winding band or tape.

Such type of equipment is known, for instance, from Swiss Pat. No. 559,691, granted Jan. 31, 1975. With such equipment or apparatus, a further supply spool member and guide rolls for a second winding band are arranged above the stationarily arranged conveyor band arrangement which serves to infeed and outfeed, as the case may be, the substantially flat structures or products together with the winding band disposed therebelow. At the end of the conveyor band arrangement, the two winding bands or tapes, which are practically of the same width as the substantially flat structures, form a conveying gap in which the flat structures are fixedly clamped and delivered in so-called overfeed, together with the winding bands, to the driven winding core member and are wound thereupon in conjunction with the winding bands.

This solution is not only disadvantageous by virtue of the two winding bands or tapes which are required, but also for the reasons that there is limited the length of the conveying gap provided between the conveyor band arrangement and the winding core member or the package, as the case may be, and which conveying gap is only formed by both of the winding bands or tapes. In the event that the substantially flat structures are comparatively heavy, the danger exists that the lower winding band will sag at the region of the aforementioned conveying gap due to the unavoidable elongation thereof. Consequently, the upper winding band no longer remains in contact with the substantially flat structures Hence, at higher conveying velocities, these substantially flat structures are no longer adequately guided to ensure for an orderly winding-up or winding-off operation, as the case may be. It would be possible to somewhat ameliorate such drawback in that, in particular, the lower winding band would be placed under an appreciable tension or load which would reduce the tendency of sagging or hanging through. However, that would, in turn, require that during the wind-up of the flat structures, the drive of the winding core member, particularly in the case of increasing diameter of the wound package, would have to provide a rotational moment or torque which overcomes such tensional load, in other words, the drive would have to furnish an appreciably greater output for a given rotational speed.

SUMMARY OF THE INVENTION

Therefore, with the foregoing in mind, it is a primary object of the present invention to provide a new and improved construction of an apparatus for the continuous winding-up and winding-off or unwinding of substantially flat or superficial structures or products, in a manner which is not afflicted with the aforementioned drawbacks and shortcomings.

Another and more specific object of the present invention aims at the provision of a new and improved construction of an apparatus for the continuous winding-up and winding-off or unwinding of substantially flat or superficial structures or products, especially, although not exclusively, printed products in an imbricated formation, wherein the apparatus ensures for orderly winding-up and winding-off or unwinding of the substantially flat structures or products.

Still a further significant object of the present invention relates to a new and improved construction of a winding apparatus of the character described which is structured such that there is employed a winding core member which can be selectively elevationally shifted or displaced, both during a winding-up operation or winding-off operation of the substantially flat structures or products so as to accommodate the position of the winding core member to the undergoing winding operation, whether such be a wind-up or wind-off operation of the products.

Yet a further noteworthy object of the present invention relates to a new and improved construction of an apparatus for the continuous winding-up and unwinding of substantially flat or superficial structures or products, which winding apparatus is relatively simple in construction and design, quite economical to manufacture, highly reliable in operation, not readily subject to breakdown or malfunction and requires a minimum of maintenance and servicing.

Now in order to implement these and still further objects of the invention, which will become more readily apparent as the description proceeds, the conveyor band or belt arrangement is structured as a freely revolving conveyor band or belt arrangement and, under resilient or spring action, partially trains or wraps about the winding core member or the package located thereon, as the case may be, and engages therewith from below or in underfeed. The drive elements for the winding core member are mounted at a substantially vertically guided displaceable carriage or slide member which can be elevationally shifted, in other words, raised and lowered by means of an elevational or elevating or lift drive which can be controlled as a function of the momentary position of the conveyor band or belt arrangement.

It is known in similar types of apparatuses to guide the conveyor band or belt arrangement in underfeed to or away from the winding core member and the package formed thereupon. With such prior art apparatuses, it is to be observed, however, the mounting or support structure for the winding core member is arranged at a constant or invariable height. As a result, the conveyor band or belt arrangement must be designed as a pivotable rocker or balance member which is capable of contacting the entire diameter range encompassing the diameter of the winding core up to the maximum diameter of the wound package in the manner of a pick-up arm of a record player, without the inclination of the conveyor band arrangement assuming such values which would result in sliding of the substantially flat structures upon the conveyor band arrangement. It will be recalled that these flat structures are delivered to and outfed from the conveyor band arrangement while freely reposing thereon. Accordingly, with such state of the art apparatuses, the length of the rocker-like conveyor band arrangement is dimensioned to possess a comparatively considerable value. Hence, there prevail relatively large space requirements for apparatuses equipped with a mounting or bearing structure for the winding core member which is arranged at a constant height or position, and thus, there can be practically not circumvented the need for providing a direct drive of the conveyor band arrangement.

This undesirable situation does not exist with the apparatus proposed according to the invention. This is so because the location where the substantially flat or superficial structures or products are infed to the package or outfed from the package, as the case may be, always is situated at the region of the lowest point or site of the package, in other words, at a practically constant height. The conveyor band or belt arrangement need not be directly driven because it can be indirectly entrained by the winding core member or, as the case may be, the product package located thereupon.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
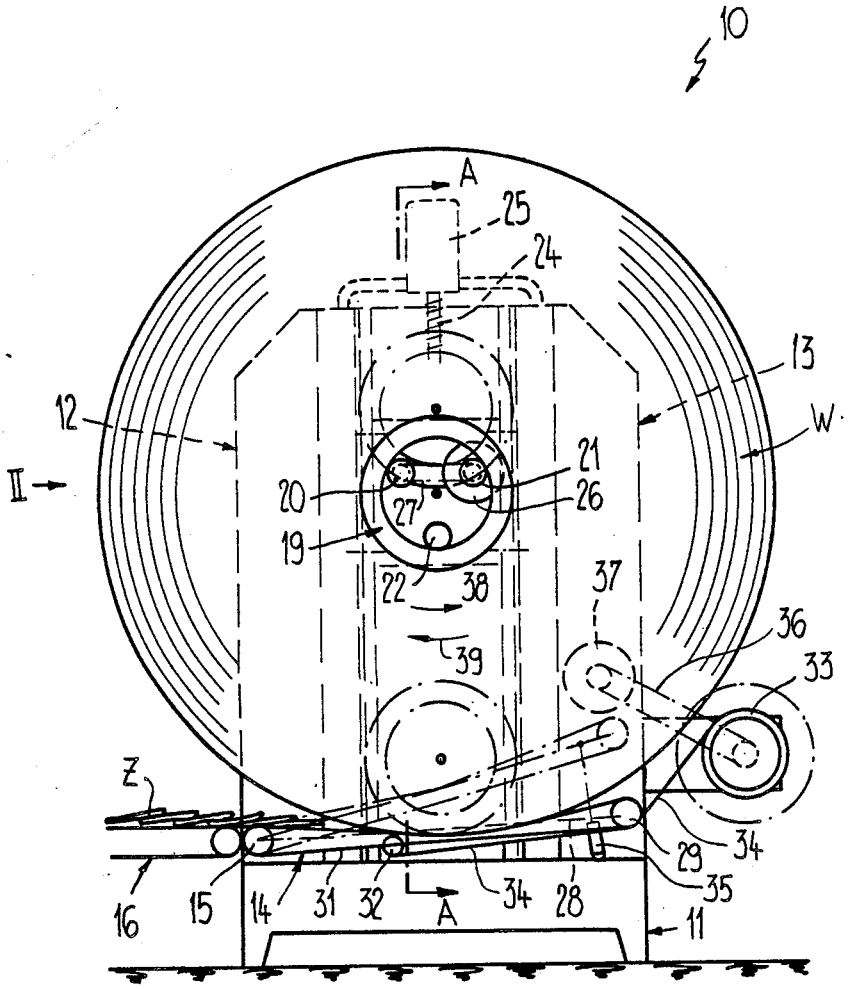
FIG. 1 is a schematic front view of a winding apparatus for the continuous winding-up or winding-off of substantially flat structures or products and constructed according to the present invention.

Describing now the drawings, it is to be understood that only enough of the construction of the winding apparatus for the continuous winding-up or winding-off or unwinding of substantially flat or superficial structures or products, has been depicted in the drawings, to simplify the illustration thereof, as is needed to enable one skilled in the art to readily understand the underlying principles and concepts of the present development. It is again remarked that the term winding-up apparatus or equivalent terminology is used in this document in its broader sense or at least in a sense where it should be understood as referring to both winding-up apparatus and winding-off or unwinding apparatus for substantially flat or superficial structures or products. It is believed that the description contained in this disclosure should make such readily evident anyway.

Turning attention now specifically to the drawings, it will be observed that the illustrated exemplary embodiment of winding apparatus 10 comprises a base portion or socket member 11 at which there are anchored, on the one hand, two upright or substantially vertically extending guide columns or post members 12 and 13 and, on the other hand, there is mounted only a schematically illustrated conveyor band or belt arrangement 14. The deflection roll or roller 15 of the conveyor band or belt arrangement 14 merges with or is disposed in neighboring relationship to a conveyor device or conveyor 16, wherein in the illustrations of FIGS. 1 and 3, there have only been depicted the so-called end or terminal portion or the starting portion, depending upon whether the apparatus is used for a product winding-up operation or a product winding-off operation.

Between both of the guide column members 12 and 13, there is mounted a carriage or slide member 18 which is displaceably guided by means of the rolls or rollers 17. The drive elements, which will be considered more fully hereinafter, for a hollow substantially cylindrical winding core or mandrel member 19, extend away from the carriage or slide member 18. These drive elements or components comprise two drive wheels or rolls 20 and 21 or equivalent structure which drive by the action of friction, the winding core member 19 from the interior thereof as well as a freely rotatably mounted tensioning roll or roller 22 which retains the winding core member 19 in contact with the drive wheels 20 and 21. This type of drive device for a hollow substantially cylindrical winding core member, as is here the case for the winding core member 19, has been disclosed in detail, for instance, in the European Published patent application No. 0,161,569 and the commonly assigned U.S. Pat. No. 4,601,436, granted July 22, 1986 to which reference may be readily had and the disclosure of which is incorporated herein by reference. However, it should be understood that also a differently constructed type of drive device for the winding core member can be provided, and this winding core member need not be necessarily hollow cylindrical in its configuration.

Figure 2:
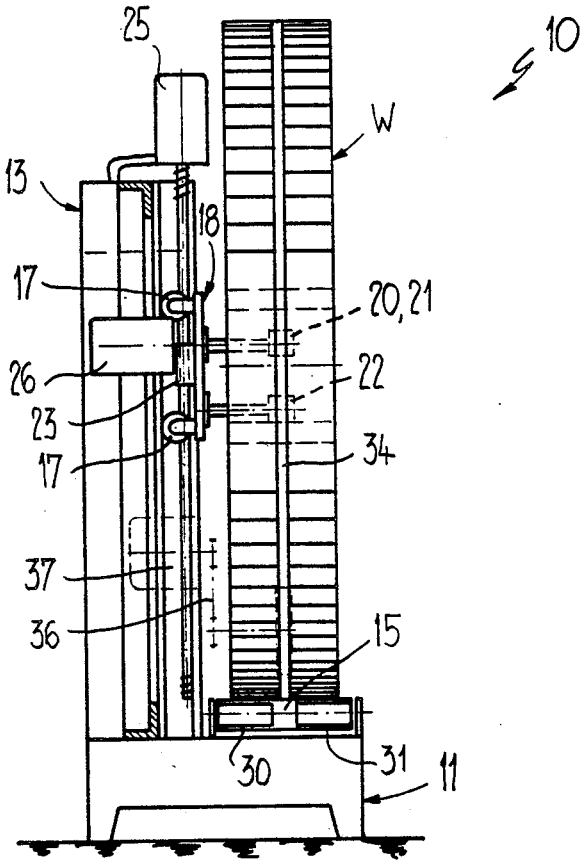
FIG. 2 is a side view of the apparatus depicted in FIG. 1, looking in the direction of the arrow II thereof, wherein the left half of the illustration of FIG. 2 is a sectional view taken substantially along the section line A—A of FIG. 1.

As will be recognized from the illustration of FIG. 2, at the carriage or slide member 18, there is anchored a mother or mating element, here shown in the form of a nut element or piece 23 through which piercingly extends a threaded spindle member or spindle 24 disposed substantially parallel to the guide column members 12 and 13. The threaded spindle member 24 can be driven by means of a suitable, here only schematically depicted drive motor 25 which is stationarily mounted, for instance, at the guide column members 12 and 13. By means of the drive motor 25, the carriage or slide member 18 can be practically infinitely displaced and retained in a selected position over the entire height or elevational extent of the guide column members 12 and 13.

Continuing, it will also be observed that operatively coupled with the drive wheel 21 or equivalent structure, is a drive motor or drive means 26 which is flanged or otherwise appropriately attached to the carriage or slide member 18. The drive wheel 20 or equivalent structure is form-lockingly or positively coupled by means of a chain drive 27 with the drive wheel 21.

The conveyor band or belt arrangement 14 is arranged in a frame member or frame structure 28 which has been schematically shown in FIG. 1. The frame member or frame structure 28 is mounted to be pivotable about the axis of the deflection roll or roller 15 and carries at its end, appearing at the right-hand side of the illustration of FIG. 1, a further deflection roll or roller 29. Both of the deflection rolls or rollers 15 and 29 are mounted to be freely rotatable and trained by a pair of comparatively loose or non-taut conveyor bands or belts 30 and 31, as best seen by referring to FIGS. 1 and 2. Between the deflection rolls or rollers 15 and 29 as well as between the conveyor bands or belts 30 and 31, there is appropriately freely rotatably mounted at the frame member 28 a further deflection roll or roller 32. This further freely rotatably mounted deflection roll or roller 32 guides to the elevation or position of the upper run of the conveyor bands or belts 30 and 31, a winding band or tape 34 guided over or along the deflection roll or roller 29 and withdrawn or wound-up, as the case may be, from or onto a supply spool or roller member 33. During such operation, the deflection roll or roller 32 allows the thus guided winding band or tape 34 to move in the same direction or sense as the direction of movement of the upper runs of the conveyor bands or belts 30 and 31.

The frame member 28 and thus the conveyor bands or belts 30 and 31 as well as also the winding band or tape 34 are upwardly forced or displaced by the action of a suitable resilient element or spring means 35, for instance, a conventional gas spring, so that the comparatively loose or non-taut conveyor bands or belts 30 and 31 are forced against the circumference or outer surface of the product package W which is located upon the winding core member 19 and trained about such product package W throughout a comparatively large arc length. If the product package W is driven in the one or other possible rotational direction by appropriately rotating the winding core member 19, then the conveyor bands or belts 30 and 31 conjointly move and the winding band or tape 34 is either unwound from or wound onto the supply spool or roll member 33, as the case may be.

For this purpose, the supply spool or roll member 33 is form-lockingly or positively coupled by means of a chain drive or drive means 36 with a torque or moment-controlled machine or device 37, which will be discussed more fully hereinafter, particularly in conjunction with the description of FIG. 3. From what has been previously described, it should be apparent that the apparatus is quite suitable for the production or fabrication of product packages of the most different package diameters, and additionally, the finished or completely wound product packages W can be raised or lifted, independent of their diameter by means of the threaded spindle member 24, to such an extent that they can be removed from the side of the product package W located opposite to the location of the carriage or slide member 18, in other words, from the right-hand side of the illustration of FIG. 2, from the drive wheels or rolls 20 and 21 and the tension roll 22 or the like by any suitable transport vehicle which can be maneuvered to such location, for instance, by a forklift truck, and then such removed product packages W can be transported to an intermediate storage location or site. In FIG. 1, there has been depicted with chain-dot circles, the respective lowermost and uppermost elevational position of the winding core member 19. By means of the arrow 38, there has been indicated the direction of rotation of the product package W during its formation or winding-up of the substantially flat structures or products Z whereas the arrow 39 indicates the direction of rotation of the product package W during unwinding of such substantially flat products or structures Z.

Figure 3:
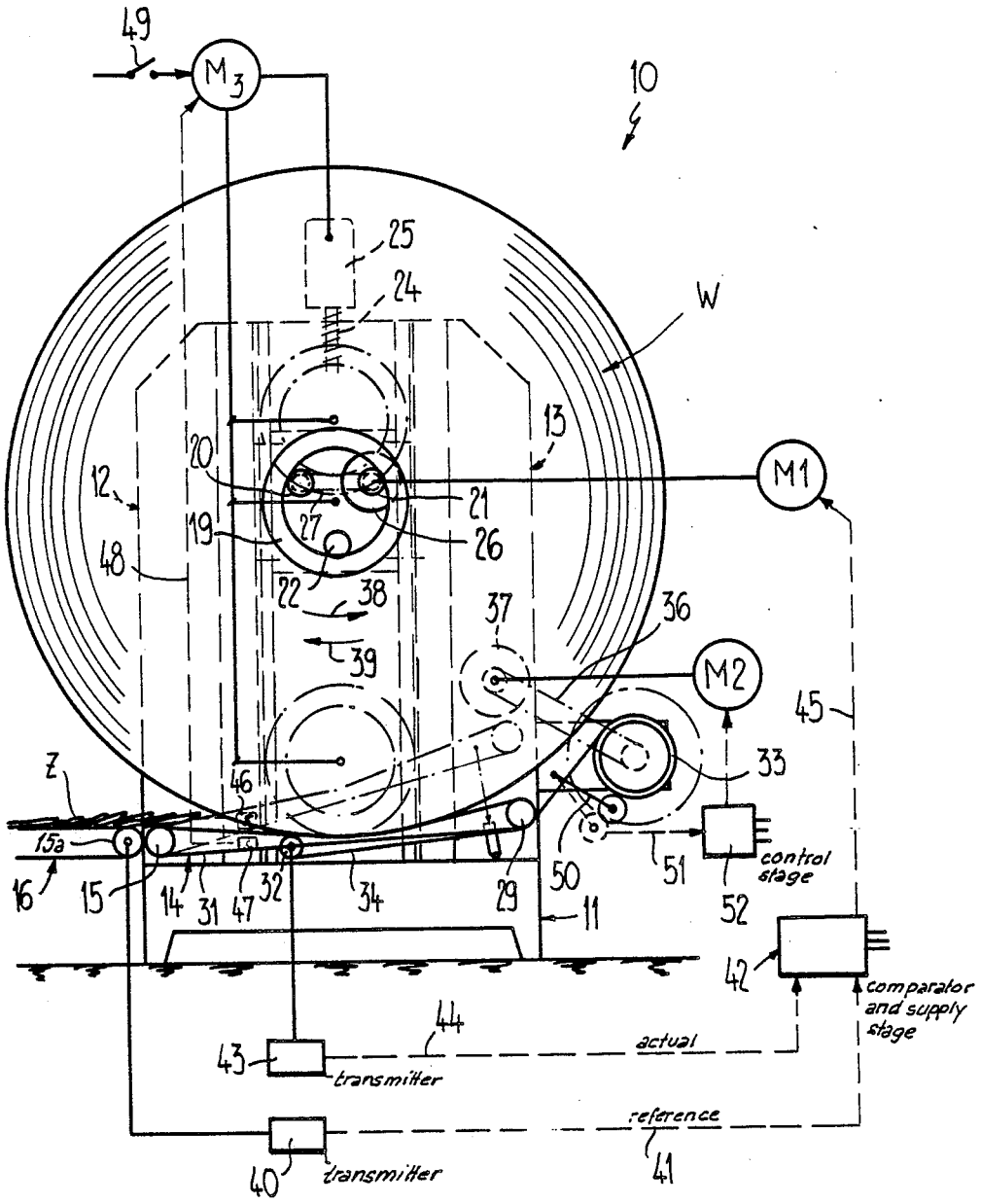
FIG. 3 is an illustration like that of FIG. 1 but schematically depicting the drive means and the control elements therefor in order to enhance the understanding of the present invention.

With attention now invited to FIG. 3, it is to be understood that the same corresponds extensively to the showing of the apparatus depicted in FIG. 1, however, there has been introduced into such FIG. 3, a block circuit diagram of the electrical circuitry in order to enhance the understanding of the invention. In FIG. 3, the drive motor 26 has been symbolized by the schematically illustrated structure M1, the drive motor 25 by the schematically illustrated structure M3 and the torque or moment-controlled machine or device 37 has been symbolized by the structure M2.

At the illustrated deflection roll 15*a* of the conveyor device or conveyor 16, there is coupled a suitable transmitter 40, for instance, a tachogenerator, which produces a "reference" signal as a function of the velocity and the conveying direction of the conveyor device 16. This "reference" signal is delivered by means of a line or conductor 41 to a comparator and power supply or supply stage 42.

Equally coupled with the deflection roll or roller 32 for the winding band or tape 34, is a transmitter 43 which produces or generates an "actual" signal or actual value signal as a function of the actual circumferential velocity and the direction of rotation of the product package W. This "actual" signal or actual value signal is infed or delivered by means of a line or conductor 44 to the comparator and power supply or supply stage 42. As a function of the differential signal which has been determined by the comparator and power supply or stage 42, the latter controls, by means of the supply line or conductor 45, the drive motor 26 (M1) in such a manner that the rotational speed with which such drive motor 26 (M1) drives the winding core member 19 results in a circumferential velocity of the product package W which, as concerns direction and velocity, corresponds to that of the conveyor device 16. For this purpose, the drive motor 26 (M1) can be a reversible direct-current machine or a frequency-controlled polarity-switchable or pole-changing asynchronous motor.

Operatively associated with the conveyor band or belt arrangement 14, are two sensor or feeler members 46 and 47, for instance, light barriers or photo cell structures, which detect the momentary or current position of the upper runs of the conveyor bands or belts 30 and 31. If the sensor or sensor element 47 responds, then the drive motor 25 (M3) is powered by means of the line or conductor 48 in such a manner that the threaded spindle member 24 is operated so as to raise the carriage or slide member 18, and thus the product package W and remains turned-on or effectual, during the product wind-up operation, for such length of time until the sensor or sensor element 46 responds. During unwinding of the substantially flat structures or products Z from the product package W, the sensors or sensor elements 46 and 47 reverse their roles or mode of operation. The drive motor 25 (M3) can be, however, turned-on and turned-off also by means of only a schematically indicated switch or switch member 49 which bridges or shunts the sensors or sensor elements 46 and 47. It has been found to be quite advantageous to use for the drive motor 25 (M3) a reversible and polarity-switchable or pole-changing asynchronous machine. By means of the switch or switch member 49, the drive motor 25 (M3) is then turned-on when a finished wound product package W should be lifted into the highest elevational position for transfer to a suitable transport vehicle or transport mechanism, as previously explained, or when an empty winding core member 19 should be lowered to such an extent that it contacts the conveyor band or belt arrangement 14.

The winding band or tape 34 is retained, during the winding-up of the product package W, at as constant tension or tensional load as possible. Therefore, the supply spool or roll member 33, as a function of its inherent or momentary diameter, is to be braked such that the winding band or tape 34 has imparted thereto the desired tension or tensional load or stress and thus the desired elongation between the location where it departs or the outbound point from the supply spool or roll member 33 and the location of contact or inbound point at the product package W. The brake moment which is to be exerted upon the supply spool or roll member 33 is, of course, dependent upon its momentary diameter. Therefore, the supply spool or roll member 33 has operatively associated therewith, a spool diameter sensor or feeler 50 which controls, by means of a control line or conductor 51 and a control stage 52, the torque or moment-controlled machine or device 37 (M2). This torque or moment-controlled machine or device 37 (M2) is advantageously a switchable torque or moment-controlled servo direct-current machine which can be selectively operated both as a motor (drive) as well as also as a generator (brake).

During the unwinding or unreeling of the product package W, in the direction of the arrow 39 as indicated in FIGS. 1 and 3, the direction of rotation of the machine or device 37 (M2) is reversed, so that it drives, if desired, by means of a conventional and thus not particularly illustrated slip clutch or coupling, the supply spool or roll member 33 approximately in a manner equatable to the take-up spool of a magnetic tape recorder. As a result, the freed winding band or tape 34 is again tightly wound onto the supply spool or roll member 33, whereas the substantially flat or superficial structures or products Z arrive at the conveyor device or conveyor 16 by means of the conveyor band or belt arrangement 14.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for continuous winding-up or unwinding of substantially flat structures, especially printed products in imbricated formation, selectively into a product package or from a product package, comprising:

a driven and elevationally adjustable winding core member;

a supply spool member for a winding band which is to be selectively wound-up with the substantially flat structures from which there is formed the product package or unwound together with the substantially flat structures from the product package;

a conveyor device for the selective infeed of the substantially flat structures which are to be wound-up or the outfeed of the unwound substantially flat structures;

a conveyor band arrangement for the selective infeed of the substantially flat structures and the winding band which are to be wound-up to form the product package or for the outfeed of the substantially flat structures and the winding band which are unwound from the product package;

said conveyor band arrangement being arranged between said conveyor device and said winding core member;

said conveyor band arrangement containing at least one conveyor band trained around non-driven deflection means for entrainment in a freely revolving movement;

means for elevationally resiliently urging said conveyor band arrangement so as to contact in underfeed and from below the winding core member or the product package located upon said winding core member and thereby entrain said at least one conveyor band of said conveyor band arrangement in said freely revolving movement;

drive means for driving said winding core member;

said drive means comprising drive elements drivingly interconnecting said drive means and said winding core member;

an elevationally adjustable carriage member;

means for guiding said elevationally adjustable carriage member for movement in a substantially upright direction;

said drive means for driving said winding core member being mounted at said elevationally adjustable carriage member; and elevational drive means for raising and lowering said elevationally adjustable carriage member and conjointly therewith said drive means and said winding core member and controllable as a function of the momentary elevational position of said conveyor band arrangement.

2. The apparatus as defined in claim 1, wherein:

said means for guiding said elevationally carriage adjustable member guides said carriage member for elevational movement in a substantially vertical direction.

3. An apparatus for continuous winding-up or unwinding of substantially flat structures, especially printed products in imbricated formation, selectively into a product package or from a product package comprising:

a driven and elevationally adjustable winding core member;

a supply spool member for a winding band which is to be selectively wound-up with the substantially flat structures from which there is formed the product package or unwound together with the substantially flat structures from the product package;

a conveyor device for the selective infeed of the substantially flat structures which are to be wound-up or the outfeed of the unwound substantially flat structures;

a conveyor band arrangement for the selective infeed of the substantially flat structures and the winding band which are to be wound-up to form the product package or for the outfeed of the substantially flat structures and the winding band which are unwound from the product package;

said conveyor band arrangement being arranged between said conveyor device and said winding core member;

said conveyor band arrangement containing at least one conveying band trained around non-driven deflection means for entrainment in a freely revolving movement;

means for resiliently urging said conveyor band arrangement so as to contact in underfeed and from below the winding core member or the product package located upon said winding core member and thereby entrain said at least one conveyor band of said conveyor band arrangement in said freely revolving movement;

drive means for driving said winding core member;

said drive means comprising drive elements;

a displaceable carriage member;

means for guiding said displaceable carriage member for movement in a substantially upright direction;

said drive elements for said winding core member being mounted at said displaceable carriage member;

elevational drive means for raising and lowering said displaceable carriage member and controllable as a function of the momentary position of said conveyor band arrangement;

said conveyor band arrangement being disposed in neighboring relationship to said conveyor device;

said conveyor band arrangement including a deflection roll situated adjacent said conveyor device;

said conveyor band arrangement being mounted for pivotable movement about said deflection roll situated adjacent said conveyor device;

position sensor means operatively associated with said conveyor band arrangement and serving to sense the pivotable position of said conveyor band arrangement; and said position sensor means being operatively associated with said elevational drive means for selectively turning-on and turning-off said elevational drive means.

4. The apparatus as defined in claim 3, wherein:

said position sensor means comprise light barrier means.

5. The apparatus as defined in claim 3, wherein:

said elevational drive means comprise:

a substantially upright disposed threaded spindle member;

a drive motor for driving said substantially upright disposed threaded spindle member;

a nut member secured to said carriage member; and said substantially upright disposed spindle member engaging with said nut member.

6. The apparatus as defined in claim 5, wherein:

said substantially upright disposed threaded spindle member defines a substantially vertically positioned threaded spindle member.

7. The apparatus as defined in claim 1, wherein:

said elevational drive means comprise:

a substantially upright disposed threaded spindle member;

a drive motor for driving said substantially upright disposed threaded spindle member;

a nut member secured to said elevationally adjustable carriage member; and said substantially upright disposed threaded spindle member engaging with said nut member.

8. The apparatus as defined in claim 7, wherein:

said substantially upright disposed threaded spindle member defines a substantially vertically positioned threaded spindle member.

9. The apparatus as defined in claim 1, further including:

a drive motor of said drive means for driving said winding core member is mounted at said elevationally adjustable carriage member; and said drive elements for the winding core member being operatively connected with said drive motor.

10. The apparatus as defined in claim 9, wherein:

said drive motor is flanged to said elevationally adjustable carriage member.

11. The apparatus as defined in claim 7, wherein:

said drive motor for driving said substantially upright disposed threaded spindle member comprises a reversible and pole-changeable asynchronous motor.

12. The apparatus as defined in claim 1, wherein:

said at least one conveyor band of said conveyor band arrangement comprises two conveyor bands arranged at a lateral spacing from one another;

each of said two laterally spaced conveyor bands having an upper run which contacts the winding core member or the product package located thereupon;

a deflection roll arranged at the region of said upper runs and between the two laterally spaced conveyor bands; and said deflection roll being operatively associated with said supply spool member and serving for the selective infeed of the winding band or outfeed of the winding band.

13. The apparatus as defined in claim 12, wherein:

said deflection roll comprises a freely rotatable roll member.

14. The apparatus as defined in claim 3, further including:

switch means for turning-on and turning-off the elevational drive means independent of response of said position sensor means.

15. An apparatus for continuous winding of substantially flat structures, selectively into a product package or from a product package, comprising:

a driven and elevationally adjustable winding core member;

a supply spool member for a winding band which is to be selectively wound-up with the substantially flat structures from which there is formed the product package or unwound together with the substantially flat structures from the product package;

a conveyor device for the selective infeed of the substantially flat structures which are to be wound-up, or outfeed of the unwound substantially flat structures;

conveyor band means for the selective infeed of the substantially flat structures and the winding band which are to be wound-up to form the product package, or outfeed of the substantially flat structures and the winding band which are unwound from the product package;

said conveyor band means being arranged to cooperate with said conveyor device and selectively either one of said winding core member or said product package;

said conveyor band means comprising a conveyor band arrangement containing at least one conveying band trained around non-driven deflection means for entrainment in a freely revolving movement;

means for elevationally urging said conveyor band means so as to selectively contact from below either one of the winding core member or the product package located upon said winding core member and thereby entrain said at least one conveying band of said conveyor band arrangement in said freely revolving movement;

drive means for driving said winding core member;

said drive means comprising drive elements drivingly interconnecting said drive means and said winding core member;

an elevationally adjustable carriage member;

means for guiding said elevationally adjustable carriage member for movement in a predetermined direction;

said drive means for driving said winding core member being mounted at said elevationally adjustable carriage member; and means for raising and lowering said elevationally adjustable carriage member for movement in said predetermined direction conjointly with said drive means and said winding core member in dependency upon the momentary elevational position of said conveyor band means.

* * * * *